US008789817B2

(12) United States Patent
Kuno et al.

(10) Patent No.: US 8,789,817 B2
(45) Date of Patent: Jul. 29, 2014

(54) SPRING STEEL AND SPRING HAVING SUPERIOR CORROSION FATIGUE STRENGTH

(75) Inventors: Takanori Kuno, Nagoya (JP); Tomohiro Nakano, Nagoya (JP); Takayuki Sakakibara, Nagoya (JP); Masami Wakita, Nagoya (JP); Shingo Mimura, Nagoya (JP)

(73) Assignee: Chuo Hatsujo Kabushiki Kaisha, Nagoya-Shi (JP)

( * ) Notice: Subject to any disclaimer, the term of this patent is extended or adjusted under 35 U.S.C. 154(b) by 608 days.

(21) Appl. No.: 12/892,439

(22) Filed: Sep. 28, 2010

(65) Prior Publication Data

US 2011/0074076 A1 Mar. 31, 2011

(30) Foreign Application Priority Data

Sep. 29, 2009 (JP) ..... 2009-225422
Sep. 29, 2009 (JP) ..... 2009-225423
Sep. 29, 2009 (JP) ..... 2009-225424
Jan. 19, 2010 (JP) ..... 2010-009072

(51) Int. Cl.
*C22C 38/42* (2006.01)

(52) U.S. Cl.
USPC ..... 267/2; 148/333; 148/580; 267/158; 267/166

(58) Field of Classification Search
USPC ..... 267/2, 33–35, 155–157, 166, 182; 148/320–334, 580, 598
See application file for complete search history.

(56) References Cited

U.S. PATENT DOCUMENTS 4,448,617 A 5/1984 Yamamoto et al.
4,544,406 A 10/1985 Yamamoto et al.
5,009,843 A 4/1991 Sugimoto et al.
5,183,634 A 2/1993 Abe et al.
5,225,008 A 7/1993 Koyama et al.
5,258,082 A 11/1993 Koyama et al.
5,286,312 A 2/1994 Shimotsusa et al.
5,508,002 A 4/1996 Kawaguchi et al.
5,575,973 A 11/1996 Choi et al.
5,846,344 A 12/1998 Kawaguchi et al.
5,863,358 A 1/1999 Krzysztalowicz
5,897,717 A 4/1999 Hashimura et al.
6,017,641 A 1/2000 Aoki et al.

(Continued)

FOREIGN PATENT DOCUMENTS

JP H01191745 A 8/1989
JP 03-037434 A 2/1991

(Continued)

OTHER PUBLICATIONS

Office Action mailed Apr. 25, 2012 for U.S. Appl. No. 12/892,444.

(Continued)

*Primary Examiner* — Christopher Schwartz
(74) *Attorney, Agent, or Firm* — J-Tek Law PLLC; Jeffrey D. Tekanic

(57) ABSTRACT

A high-strength spring steel and a spring are provided that have superior corrosion fatigue strength. The spring steel comprises, in mass percent, 0.35-0.55% C, 1.60-3.00% Si, 0.20-1.50% Mn, 0.10-1.50% Cr, and at least one of 0.40-3.00% Ni, 0.05-0.50% Mo and 0.05-0.50% V, the balance being substantially Fe and incidental elements and impurities.

19 Claims, 1 Drawing Sheet

Table 3

| | Formula 1 | | Formula 2 | | Formula 3 | | Formula 4 | | Formula 5 | | Corrosion endurance cycles | Charpy impact value | Delayed fracture strength |
|---|---|---|---|---|---|---|---|---|---|---|---|---|---|
| | 0.400 to 0.800 | | 0.540 to 0.670 | | 1.2 or more | | 84 or less | | 1.2 or less | | (cycles) | J/cm² | MPa |
| Sample 1 | 0.758 | Y | 0.668 | Y | 1.222 | Y | 78.83 | Y | 0.63 | Y | 42518 | 82 | |
| Sample 2 | 0.737 | Y | 0.665 | Y | 1.213 | Y | 78.77 | Y | 0.65 | Y | 41307 | 74 | |
| Sample 3 | 0.735 | Y | 0.634 | Y | 1.489 | Y | 79.55 | Y | 0.91 | Y | 49493 | 86 | 1020 |
| Sample 4 | 0.754 | Y | 0.655 | Y | 1.693 | Y | 80.88 | Y | 0.74 | Y | 59021 | 86 | 980 |
| Sample 5 | 0.771 | Y | 0.644 | Y | 1.678 | Y | 79.43 | Y | 0.71 | Y | 50595 | | |
| Comp. Sample1 | 0.803 | N | 0.716 | N | 0.899 | N | 80.92 | Y | 0.52 | Y | 28682 | 81 | |
| Comp. Sample2 | 0.802 | N | 0.656 | N | 1.238 | N | 80.52 | Y | 0.96 | Y | 32491 | 78 | |
| Comp. Sample3 | 0.747 | Y | 0.672 | N | 0.823 | N | 82.4 | Y | 1.14 | Y | 26538 | | |
| Comp. Sample4 | 0.751 | Y | 0.680 | N | 0.829 | N | 83.79 | Y | 1.19 | Y | 30777 | | |
| Comp. Sample5 | 0.784 | Y | 0.713 | N | 0.553 | N | 84.4 | N | 1.06 | Y | 27821 | 75 | 900 |
| Comp. Sample6 | 0.753 | Y | 0.693 | N | 0.977 | N | 83.73 | N | 0.98 | Y | 35813 | | |
| Comp. Sample7 | 0.786 | Y | 0.678 | N | 0.963 | N | 81.9 | N | 0.95 | Y | 25920 | | |
| Comp. Sample8 | 0.800 | Y | 0.689 | N | 1.132 | N | 83.03 | N | 0.91 | Y | 31636 | | 766 |

(56) References Cited

U.S. PATENT DOCUMENTS

| | | | | |
|---|---|---|---|---|
| 6,027,577 | A | 2/2000 | Mikura et al. | |
| 6,193,816 | B1 | 2/2001 | Nakano et al. | |
| 6,375,174 | B2 | 4/2002 | Hasegawa et al. | |
| 6,406,565 | B1 | 6/2002 | Hashimura et al. | |
| 6,543,757 | B2 | 4/2003 | Imaizumi | |
| 6,544,360 | B1 | 4/2003 | Tange et al. | |
| 6,550,301 | B2 | 4/2003 | Hasegawa | |
| 6,616,131 | B2 | 9/2003 | Imaizumi | |
| 6,648,996 | B2 | 11/2003 | Hasegawa | |
| 6,712,346 | B2 | 3/2004 | Imaizumi | |
| 6,779,564 | B2 | 8/2004 | Hasegawa et al. | |
| 6,836,964 | B2 | 1/2005 | Hasegawa et al. | |
| 7,407,555 | B2 | 8/2008 | Yoshikawa et al. | |
| 7,597,768 | B2 | 10/2009 | Suda et al. | |
| 7,615,186 | B2 | 11/2009 | Suda et al. | |
| 7,699,943 | B2 | 4/2010 | Nakano et al. | |
| 7,776,440 | B2 | 8/2010 | Kunita et al. | |
| 8,328,169 | B2 * | 12/2012 | Kuno et al. | 267/2 |
| 8,349,095 | B2 | 1/2013 | Nakano et al. | |
| 2005/0173028 | A1 | 8/2005 | Suda et al. | |
| 2006/0060269 | A1 | 3/2006 | Nakano et al. | |
| 2006/0169367 | A1 | 8/2006 | Yuse et al. | |
| 2006/0196584 | A1 | 9/2006 | Kochi et al. | |
| 2006/0201588 | A1 | 9/2006 | Suda et al. | |
| 2006/0225819 | A1 | 10/2006 | Yoshihara | |
| 2007/0163680 | A1 * | 7/2007 | Suda et al. | 148/333 |
| 2007/0256765 | A1 * | 11/2007 | Kimura et al. | 148/580 |
| 2007/0267112 | A1 | 11/2007 | Yoshikawa et al. | |
| 2008/0163957 | A1 | 7/2008 | Brady et al. | |
| 2008/0271824 | A1 | 11/2008 | Fujino et al. | |
| 2008/0308195 | A1 | 12/2008 | Yoshihara et al. | |
| 2009/0020189 | A1 | 1/2009 | Yoshihara et al. | |
| 2009/0020195 | A1 | 1/2009 | Kubota et al. | |
| 2009/0079246 | A1 | 3/2009 | Okura et al. | |
| 2009/0114318 | A1 * | 5/2009 | Arai et al. | 148/593 |
| 2009/0174129 | A1 | 7/2009 | Izumida et al. | |
| 2009/0205753 | A1 | 8/2009 | Hashimura et al. | |
| 2009/0283181 | A1 | 11/2009 | Suda et al. | |
| 2009/0293998 | A1 | 12/2009 | Fujino et al. | |
| 2010/0034691 | A1 | 2/2010 | Yoshihara | |
| 2010/0175795 | A1 | 7/2010 | Choi et al. | |
| 2010/0224287 | A1 | 9/2010 | Kochi et al. | |
| 2011/0074077 | A1 | 3/2011 | Kuno et al. | |
| 2011/0074078 | A1 | 3/2011 | Nakano et al. | |
| 2011/0074079 | A1 | 3/2011 | Nakano et al. | |
| 2011/0303327 | A1 | 12/2011 | Yoshihara et al. | |
| 2013/0008566 | A1 | 1/2013 | Suzuki et al. | |
| 2013/0285299 | A1 | 10/2013 | Kuno et al. | |

FOREIGN PATENT DOCUMENTS

| | | | |
|---|---|---|---|
| JP | H05-78785 | A | 3/1993 |
| JP | H05-195153 | A | 8/1993 |
| JP | 5-271879 | | 10/1993 |
| JP | H07-179985 | A | 7/1995 |
| JP | H07173577 | A | 7/1995 |
| JP | 7-292435 | A | 11/1995 |
| JP | H10287958 | A | 10/1998 |
| JP | H11241143 | A | 9/1999 |
| JP | 2000-282176 | | 10/2000 |
| JP | 2000326036 | A | 11/2000 |
| JP | 2001082518 | A | 3/2001 |
| JP | 2001-220650 | | 8/2001 |
| JP | 2003105498 | A | 4/2003 |
| JP | 2003-147479 | | 5/2003 |
| JP | 2005-29870 | A | 2/2005 |
| JP | 2006291291 | A | 10/2006 |
| JP | 2007063584 | A | 3/2007 |
| JP | 2007224413 | A | 9/2007 |
| JP | 2008133539 | A | 6/2008 |
| JP | 2008-261055 | | 10/2008 |
| WO | 2004085685 | A | 10/2004 |
| WO | 2006022009 | A | 3/2006 |
| WO | 2007114491 | A | 10/2007 |

OTHER PUBLICATIONS

Office Action mailed Apr. 25, 2012 for U.S. Appl. No. 12/892,445.
Amendment and Response to non-final Office Action mailed Apr. 25, 2012 for U.S. Appl. No. 12/892,445.
Amendment and Response to non-final Office Action mailed Apr. 25, 2012 for U.S. Appl. No. 12/892,444.
Excerpt from the textbook SPRING, 4th edition edited by the Japan Society of Spring Engineers 2008, p. 508.
Non-final Office Action mailed Sep. 11, 2013 for related U.S. Appl. No. 12/892,434.
Unpublished U.S. Appl. No. 13/978,321.
Office Action from the Japanese Patent Office mailed Dec. 11, 2013 in counterpart JP application No. 2010-009072, including English translation of prior art rejection.
Office Action from the Japanese Patent Office mailed Dec. 17, 2013 in counterpart JP application No. 2010-009072, including English translation of prior art rejection.
Office Action mailed Nov. 19, 2013 for counterpart (priority) Japanese patent application No. 2009-225422, including English translation of prior art rejections.
Office Action from the Japanese Patent Office mailed Nov. 19, 2013 in related JP application No. 2009-225423, including English translation of prior art rejections.
Office Action from the Japanese Patent Office mailed Nov. 19, 2013 in related JP application No. 2009-225424, including English translation of prior art rejections.
Office Action mailed Mar. 24, 2014 in related U.S. Appl. No. 12/892,434.
Final Office Action from the Japanese Patent Office mailed Mar. 4, 2014 in counterpart (priority) JP application No. 2010-009072, including English translation of prior art rejection.

* cited by examiner

Table 3

| | Formula 1 | | Formula 2 | | Formula 3 | | Formula 4 | | Formula 5 | | Corrosion endurance cycles | Charpy impact value | Delayed fracture strength |
|---|---|---|---|---|---|---|---|---|---|---|---|---|---|
| | 0.400 to 0.800 | | 0.540 to 0.670 | | 1.2 or more | | 84 or less | | 1.2 or less | | (cycles) | $J/cm^2$ | MPa |
| Sample 1 | 0.758 | Y | 0.668 | Y | 1.222 | Y | 78.83 | Y | 0.63 | Y | 42518 | 82 | |
| Sample 2 | 0.737 | Y | 0.665 | Y | 1.213 | Y | 78.77 | Y | 0.65 | Y | 41307 | 74 | |
| Sample 3 | 0.735 | Y | 0.634 | Y | 1.489 | Y | 79.55 | Y | 0.91 | Y | 49493 | 86 | 1020 |
| Sample 4 | 0.754 | Y | 0.655 | Y | 1.693 | Y | 80.88 | Y | 0.74 | Y | 59021 | 86 | 980 |
| Sample 5 | 0.771 | Y | 0.644 | Y | 1.678 | Y | 79.43 | Y | 0.71 | Y | 50595 | | |
| Comp. Sample1 | 0.803 | N | 0.716 | N | 0.899 | N | 80.92 | Y | 0.52 | Y | 28682 | 81 | |
| Comp. Sample2 | 0.802 | N | 0.656 | N | 1.238 | N | 80.52 | Y | 0.96 | Y | 32491 | 78 | |
| Comp. Sample3 | 0.747 | Y | 0.672 | N | 0.823 | N | 82.4 | Y | 1.14 | Y | 26538 | | |
| Comp. Sample4 | 0.751 | Y | 0.680 | N | 0.829 | N | 83.79 | Y | 1.19 | Y | 30777 | | |
| Comp. Sample5 | 0.784 | Y | 0.713 | N | 0.553 | N | 84.4 | N | 1.06 | Y | 27821 | 75 | 900 |
| Comp. Sample6 | 0.753 | Y | 0.693 | N | 0.977 | N | 83.73 | N | 0.98 | Y | 35813 | | |
| Comp. Sample7 | 0.786 | Y | 0.678 | N | 0.963 | N | 81.9 | N | 0.95 | Y | 25920 | | |
| Comp. Sample8 | 0.800 | Y | 0.689 | N | 1.132 | N | 83.03 | N | 0.91 | Y | 31636 | | 766 |

SPRING STEEL AND SPRING HAVING SUPERIOR CORROSION FATIGUE STRENGTH

CROSS-REFERENCE TO RELATED APPLICATION

This application claims priority to Japanese Patent Application Nos. 2009-225422, 2009-225423 and 2009-225424, all of which were filed on Sep. 29, 2009, and to Japanese Patent Application No. 2010-009072 filed on Jan. 19, 2010, the contents of all of which are hereby incorporated by reference into the present application.

TECHNICAL FIELD

The present teachings relate to a spring steel and a spring, and in preferred embodiments, to a spring steel and a spring having superior corrosion fatigue strength.

DESCRIPTION OF RELATED ART

In recent years, there has been a growing demand for spring steel and springs having higher strengths. In high-strength springs, however, when the hardness has been increased in order to maintain the sag resistance, the impact resistance, toughness and corrosion fatigue strength of the steel have tended to decrease. Various materials have been considered from the standpoint of optimizing these various properties, such as in WO 2006/022009 and its English counterpart US 2007/0256765.

SUMMARY

However, even if the material compositions described in the above-mentioned patent document are used, it has been difficult to optimize each of the above-mentioned properties at an acceptable level and at a low cost. Therefore, an object of the disclosure of the present teachings is to disclose improved spring steels and springs, e.g., having superior corrosion fatigue strength or corrosion fatigue resistance (hereinafter collectively "corrosion fatigue strength").

As a result of conducting studies on various spring steel alloy compositions, the inventors discovered a range of spring steel alloy compositions that, e.g., exhibit satisfactory corrosion fatigue strength while also maintaining high strength.

For example, a preferred spring steel may comprise, in terms of percent by mass:

0.35-0.55% C;

1.60-3.00% Si;

0.20-1.50% Mn;

0.10-1.50% Cr; and at least one element selected from the group consisting of: 0.40-3.00% Ni, 0.05-0.50% Mo and 0.05-0.50% V;

the balance being substantially or predominantly Fe, minor incidental elements and impurities, wherein the following formulas (1) and (2) are satisfied:

$$0.400\% \leq C(\%)+Mn(\%)/6+Si(\%)/24+Ni(\%)/40+Cr(\%)/5+Mo(\%)/4+V(\%)/14 \leq 0.800\% \quad (1) \text{ and}$$

$$0.540\% \leq C(\%)+Mn(\%)/6+Si(\%)/24 \leq 0.670\% \quad (2).$$

All percentages mentioned herein are mass percentages, unless otherwise indicated.

In one aspect of the present teachings, the spring steel preferably also satisfies formula (3):

$$1.20\% \leq Si(\%)-0.46C(\%)-1.08Mn(\%) \quad (3).$$

In addition or in the alternative, the spring steel may further satisfy at least one of following formulas (4) and (5):

$$159C(\%)-Si(\%)+8Mn(\%)+12Cr(\%) \leq 84\% \quad (4)$$

$$6.0C(\%)-Si(\%)-0.3Mn(\%)+1.4Cr(\%) \leq 1.2\% \quad (5).$$

Note that, in this optional aspect of the present teachings, only one of the above-mentioned formulas (4) and (5) need be satisfied, and the other of formulas (4) and (5) is not required to be satisfied. Alternatively, both of formulas (4) and (5) optionally may be satisfied.

In addition or in the alternative, in the spring steel, C may be 0.45 to 0.50%, Si may be 2.00 to 2.50% and/or Mn may be 0.40 to 0.50%. Moreover, the spring steel may further include Ni, Mo and/or V. C is preferably 0.46 to 0.49%.

In addition or in the alternative, after treating the spring steel by quenching and tempering, the spring steel optionally may satisfy one, two or all of the following properties (1) to (3):

(1) a corrosion endurance of 40,000 oscillation cycles or more (and preferably 45,000 or more);

(2) a Charpy impact value of 70 J/cm$^2$ or more (and preferably 80 J/cm$^2$ or more); and/or (3) a delayed fracture strength of 800 MPa or more (and preferably 910 MPa or more).

In addition, the spring steel may preferably have a Rockwell hardness of HRC 53 to 56 after the quenching and tempering.

In another aspect of the present teachings, a spring is also provided that is produced from any of the above-mentioned spring steels and optionally has an HRC value within 53 to 56.

BRIEF DESCRIPTION OF THE DRAWING

FIG. 1 shows test results concerning exemplary samples and comparative examples of the present teachings.

DETAILED DESCRIPTION OF THE INVENTION

According to the spring steels disclosed in the present teachings, a spring can be produced that has satisfactory durability, such as satisfactory corrosion fatigue strength, as a result of having the above-mentioned composition and satisfying the above-mentioned formulas (1) and (2). The composition of the alloy components in the spring steel disclosed in the present teachings contributes to the satisfactory strength and corrosion fatigue strength, and formula (1) relates to the carbon equivalents thereof. By providing these elements, namely C, Si, Mn, Cr, Mo and V, in amounts that satisfy formula (1), a spring steel having a desired strength can be easily realized by quenching and tempering, typically having a Rockwell Hardness C strength of about HRC 53 to HRC 56. In addition, by satisfying formula (2), a spring steel having satisfactory durability, such as corrosion fatigue strength, can be produced.

Representative, non-limiting examples of the present invention will now be described in further detail. This detailed description is merely intended to teach a person of skill in the art further details for practicing preferred aspects of the present teachings and is not intended to limit the scope of the invention. Furthermore, each of the additional features and teachings disclosed below may be utilized separately or in conjunction with other features and teachings to provide improved spring steel and springs comprised of the spring steel.

Moreover, combinations of features and steps disclosed in the following detail description may not be necessary to practice the invention in the broadest sense, and are instead taught merely to particularly describe representative examples of the invention. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

The following provides a detailed explanation of representative embodiments disclosed in the present teachings. Hereinbelow, the term "concentration" refers to the amount of a particular element, in terms of percent by mass, as a percentage of the total mass of the spring steel.

(Spring Steel)

The spring steel of the present teachings includes, in terms of percent by mass: 0.35 to 0.55% C, 1.60 to 3.00% Si, 0.20 to 1.50% Mn and 0.10 to 1.50% Cr.

(C: Carbon)

The concentration of C preferably is 0.35 to 0.55%. If the concentration of C in the spring steel is within this range, a spring steel having a satisfactory strength can be obtained by quenching and tempering. If the concentration of C is less than 0.35%, a spring steel having the satisfactory strength cannot be obtained after quenching and tempering for certain aspects or applications of the present teachings. In addition, if the concentration of C exceeds 0.55%, toughness may decrease and quenching cracks may occur during water quenching. Moreover, there is also a risk of a decrease in fatigue strength and corrosion fatigue strength. The concentration of C is preferably 0.45 to 0.50%, although the preferred concentration is dependent on the other alloy components and their concentrations. If the concentration of C is within this range, in addition to being easy to realize satisfactory strength, it also becomes easy to obtain satisfactory durability, including corrosion fatigue strength, by suitably satisfying 1 or 2 or more of formulas (1) to (5) in accordance with the relative concentrations of other alloy components. More preferably, the upper limit of the concentration of C is 0.49% and even more preferably 0.48%. In addition, the lower limit of the concentration of C is preferably 0.46%, and more preferably 0.47%.

(Si: Silicon)

The concentration of Si is preferably 1.60 to 3.00%. In the spring steel, a Si concentration within this range is effective for improving sag resistance, tempering properties and corrosion fatigue strength. When the concentration of Si is within this range, the corrosion fatigue strength increases with an increase in the concentration of Si. If the concentration of Si is less than 1.60%, it is difficult to obtain these effects, while if the concentration of Si exceeds 3.00%, toughness also readily decreases and decarburization is promoted during rolling and heat treatment (quenching). The lower limit of the concentration of Si in the spring steel is preferably 2.00% and more preferably 2.10% in order to optimize corrosion fatigue strength, etc.

In addition, the upper limit of the concentration of Si is preferably 2.50% and more preferably 2.40%.

(Mn: Manganese)

The concentration of Mn is preferably 0.20 to 1.50%. Satisfactory corrosion fatigue strength can be obtained in the spring steel if the Mn concentration is within this range. If the concentration of Mn exceeds 1.50%, corrosion fatigue strength tends to decrease. If the concentration of Mn is less than 0.20%, strength and quenching properties tend to decrease and cracking tends to readily occur during rolling. In view of this, the upper limit of the concentration of Mn in the spring steel is more preferably 0.70%, and even more preferably 0.50% or less. The lower limit of the concentration of Mn is more preferably 0.40%.

(Cr: Chromium)

The concentration of Cr is preferably 0.10 to 1.50%. When the concentration of Cr in the spring steel is within this range, it is useful for ensuring strength and improving quenching properties. If the concentration of Cr is less than 0.10%, these effects become insufficient for certain aspects or applications of the present teachings. In addition, if the concentration of Cr exceeds 1.50%, the tempered structure becomes heterogeneous and there is greater risk of impairing the sag resistance. The upper limit of the concentration of Cr is more preferably 0.30% and the lower limit is more preferably 0.20%.

The spring steel of the present teachings preferably includes one or two or all elements selected from the group consisting of 0.40 to 3.00% Ni, 0.05 to 0.50% Mo and 0.05 to 0.50% V. More preferably, the spring steel includes all three of these elements within the above-mentioned concentrations. In this case, in addition to obtaining satisfactory toughness, satisfactory corrosion fatigue strength is also obtained for certain aspects or applications of the present teachings.

(Ni: Nickel)

The concentration of Ni is preferably 0.40 to 3.00%. When the concentration of Ni in the spring steel is within this range, it has an effect of improving corrosion resistance. If the concentration of Ni is less than 0.40%, that effect becomes insufficient for certain aspects or applications of the present teachings. If the concentration of Ni exceeds 3.00%, further improvements in the corrosion resistance are not observed, because this effect tends to peak or reach a maximum (become saturated) at about 3.00%. More preferably, the upper limit of the concentration of Ni is 1.00% or less, and even more preferably 0.60% or less. The spring steel preferably includes at least Ni from the group of Ni, Mo and V.

(Mo: Molybdenum)

The concentration of Mo is preferably 0.05 to 0.50%. When the concentration of Mo in the spring steel within this range, corrosion fatigue strength can be improved. If the concentration of Mo is less than 0.05%, this effect becomes insufficient for certain aspects or applications of the present teachings, and if the concentration of Mo exceeds 0.50%, no further improvements in the corrosion resistance are observed, because this effect tends to peak or reach a maximum (become saturated) at about 0.50%. The concentration of Mo is preferably 0.20% or less, and more preferably 0.10% or less.

(V: Vanadium)

The concentration of V is preferably 0.05 to 0.50%. When the concentration of V in the spring steel is within this range, it is effective for reducing the size of the crystal grains and for improving the precipitation hardening. If the concentration of V is less than 0.05%, this effect becomes insufficient for this purpose, while if the concentration of V exceeds 0.50%, there is a risk of carbides forming corrosion pits in the steel surface and these pits becoming the starting points of cracking fractures. In addition, toughness decreases. More preferably, the concentration of V is 0.30% or less, and even more preferably 0.20% or less. The concentration of V is still more preferably 0.10% or less.

In addition, the spring steel can include P (phosphorous). Since P tends to cause the crystal grain boundaries to become brittle, the concentration of P is preferably 0.010% or less, and more preferably 0.005% or less.

In addition, the spring steel can include S (sulfur). Since S also tends to cause the crystal grain boundaries to become brittle in the same manner as P, the concentration of S is preferably 0.010% or less, and more preferably 0.005% or less.

The spring steel can include Cu (copper). The concentration of copper in the spring steel is preferably 0.20% or less, and more preferably 0.05% or less.

The spring steel can include Ti (titanium; preferably at a concentration of 0.005 to 0.030%) in addition to the above-described alloy components. In addition, the spring steel can include B (boron; preferably at a concentration of 0.0015 to 0.0025%). In addition to including these alloy components, the balance of the spring steel is one of at least substantially, predominantly or completely Fe (iron) and, e.g., no more than minor amounts of incidental elements and/or unavoidable impurities.

In addition to having the above-described alloy composition, the spring steel preferably satisfies one or more of the following formulas (1) to (5).

$$0.400\% \leq C(\%)+Mn(\%)/6+Si(\%)/24+Ni(\%)/40+Cr(\%)/5+Mo(\%)/4+V(\%)/14 \leq 0.800\% \quad \text{Formula (1)}$$

The lower limit value of formula (1) indicates the lower limit value for obtaining the desired strength after quenching and tempering the steel, as sufficient strength cannot be obtained for certain aspects or applications of the present teachings at values less than the lower limit value. In addition, the upper limit value of formula (1) indicates the upper limit value for obtaining the desired strength, and if the actual value exceeds the upper limit value, residual austenite increases during quenching. Further, there is a risk of incomplete martensitic transformation, resulting in the risk of the strength becoming insufficient for certain aspects or applications of the present teachings. In addition, there is also a problem of increased susceptibility to dimensional changes. The range of formula (1) is preferable for obtaining a Rockwell hardness within the range of HRC 53 to HRC 56. The above-mentioned lower limit value is preferably 0.700%, more preferably 0.730%, even more preferably 0.735%, and still more preferably 0.740%. In addition, the above-mentioned upper limit value is preferably 0.800%, more preferably 0.780%, and even more preferably 0.760%. Furthermore, the strength intended by formula (1) is preferably the Rockwell hardness C (HRC).

The spring steel preferably satisfies both the following formula (2) and formula (1). Satisfying these two formulas makes it possible to easily obtain spring steel having high strength and superior corrosion fatigue strength.

$$0.540\% \leq C(\%)+Mn(\%)/6+Si(\%)/24 \leq 0.670\% \quad \text{Formula (2)}$$

Formula (2) is a formula for controlling the particle diameter and the distribution of carbides by selecting the concentrations of C, Mn (Mn/6) and Si (Si/24) from a formula of carbon equivalents. Depending on the size and distribution of the carbides, the balance between strength and toughness differs and the delayed fracture properties change, which are believed to be closely correlated to corrosion fatigue. The upper and lower limit values of formula (2) are determined based on a correlation with the preferred corrosion fatigue strength, and if the actual value is less than the above-mentioned lower limit value, the corrosion fatigue strength decreases; the corrosion fatigue strength also decreases if the above-mentioned upper limit value is exceeded. The lower limit value is preferably 0.600%, more preferably 0.620%, even more preferably 0.630%, still more preferably 0.640%, and even still more preferably 0.650%. The upper limit value is preferably 0.660%. Furthermore, the corrosion fatigue strength intended by formula (2) is preferably a strength value obtained according to the testing method described in the examples below.

$$1.20\% \leq Si(\%)-0.46C(\%)-1.08Mn(\%) \quad \text{Formula (3)}$$

Formula (3) is a formula by which corrosion fatigue strength is obtained by selecting the concentrations of C, Si and Mn as parameters for the alloy components of the spring steel, and is a formula for obtaining spring steel having the superior corrosion fatigue strength. When the value is less than the lower limit value of formula (3), a corrosion fatigue strength sufficient for certain aspects or applications of the present teachings cannot be obtained. The lower limit value is preferably 1.30%, more preferably 1.35%, even more preferably 1.40%, still more preferably 1.45%, and even still more preferably 1.50%. In addition, although the upper limit in formula (3) is not particularly defined, the upper limit is preferably 1.90%, and more preferably 1.70% for achieving sufficient strength and inhibiting decarburization. Furthermore, the corrosion fatigue strength intended by formula (3) is preferably obtained according to the testing method described in examples below.

Although the spring steel may satisfy only formula (3), it preferably satisfies formulas (1) and/or (2) as well. In this case, a spring steel can be obtained that has a further improved or superior corrosion fatigue strength.

$$159C(\%)-Si(\%)+8Mn(\%)+12Cr(\%) \leq 84\% \quad \text{Formula (4)}$$

Formula (4) is a formula by which the Charpy impact value is obtained by selecting the concentrations C, Si, Mn and Cr as parameters for the alloy components of the spring steel, and is a formula for obtaining a spring steel having a satisfactory Charpy impact value. A sufficient Charpy impact value (toughness) for certain aspects or applications of the present teachings cannot be obtained if the upper limit value of formula (4) is exceeded. The upper limit value is preferably 82%, and more preferably 81%. Although the lower limit of the formula (4) is not particularly defined, it is preferably 60%, and more preferably 70%. Furthermore, the Charpy impact value intended by formula (4) is preferably a value obtained according to the testing method described in the examples below.

$$6.0C(\%)-Si(\%)-0.3Mn(\%)+1.4Cr(\%) \leq 1.2\% \quad \text{Formula (5)}$$

Formula (5) is a formula by which the delayed fracture strength is obtained by selecting the concentrations of C, Si, Mn and Cr as parameters for the alloy components of the spring steel, and is a formula for obtaining a spring steel having satisfactory delayed fracture strength. A delayed fracture strength sufficient for certain aspects or applications of the present teachings cannot be obtained if the upper limit value in formula (5) is exceeded. The upper limit value is preferably 1.0%, and more preferably 0.95%. Although the lower limit of formula (5) is not particularly defined, it is preferably 0.65%, more preferably 0.68%, and even more preferably 0.70% for achieving sufficient strength and inhibiting decarburization. Furthermore, he delayed fracture strength intended by formula (5) is preferably a strength value obtained according to the testing method described in the examples below.

The hardness of the spring steel is preferably adjusted to an HRC of 53 to 56 after a quenching and tempering treatment. If the Rockwell hardness is within this range, a lightweight and high-strength spring can be obtained. In addition, the corrosion fatigue strength, the Charpy impact value and/or the delayed fracture strength of the spring steel preferably satisfy the following properties after the quenching and tempering treatment. Namely, with respect to the corrosion fatigue strength, the number of corrosion endurance oscillation cycles is preferably 40,000 oscillation cycles or more, and more preferably 45,000 oscillation cycles or more. In addition, the Charpy impact value is preferably 70 J/cm$^2$ or more, more preferably 80 J/cm$^2$ or more, and even more preferably 85 J/cm$^2$ or more. Moreover, the delayed fracture strength is preferably 800 MPa or more, more preferably 900 MPa or more, even more preferably 910 MPa or more, and still more preferably 950 MPa or more.

An explanation will now be provided of preferred methods for producing a spring using the above-described spring steel. The spring steel disclosed herein can be used to produce various types of springs by performing one or more of a known hot forming step, a cold forming step, a warm forming step, etc. For example, a representative coil spring can be produced in the following manner. Specifically, after shaping the spring steel disclosed in the present teachings into a round steel bar, a wire rod, a wire, a plate material, etc., the material can be formed into the shape of the coil, then warm shot peening can be carried out on the coil, and then hot setting (also known as a hot set process and heat setting) can be carried out on the warm shot-peened coil in order to produce the spring. A coil spring for an automobile suspension having superior sag resistance and durability can be obtained by utilizing such a production method. An example of a more specific embodiment is a coil spring for an automobile suspension that is produced using the spring steel disclosed in the present description and by carrying out steps that include one or more of coil formation, heat treatment, hot setting, warm shot peening, cold shot peening and cold setting. The coil formation step may be carried out in a hot mode (at a temperature equal to or higher than the recrystallization temperature of the wire material), in a warm mode (at a temperature lower than the recrystallization temperature of the wire material) or in a cold mode (at room temperature). In addition, various conventionally known methods can be used to form the material into the shape of a coil. For example, the coil may be formed using a coiling machine or by a method in which the material is wound around a core bar.

In the heat treatment step, heat treatment is carried out on a coil that has been formed into the shape of a coil after the above-mentioned coil formation step. The heat treatment carried out in this step differs depending on whether the above-mentioned coil formation step was carried out in the hot mode, the warm mode or the cold mode. For example, if the hot mode coil formation step was utilized, quenching and tempering are carried out on the coil. Strength and toughness are imparted to the coil by quenching and tempering. On the other hand, if the cold mode coil formation step was utilized, low-temperature annealing is carried out on the coil, which removes harmful residual stress (tensile residual stress) from the interior and surface of the coil. The quenching and tempering, as well as the low-temperature annealing, can be carried out on the coil according to any conventionally known method.

In the hot setting step, the setting is carried out with the coil at a warm temperature. The hot setting improves durability by applying a directional compressive residual stress to the coil; the sag resistance of the coil is also improved by generating a comparatively large plastic deformation in the coil. In the present example, the temperature at which the hot setting is carried out can be suitably set within a temperature range that is equal to or lower than the recrystallization temperature of the wire material and is higher than room temperature. For example, hot setting of the coil can be carried out at a temperature within the range of 150 to 400° C. As a result of carrying out the setting within such a temperature range, the amount of plastic deformation imparted to the coil can be increased and sag resistance can be improved. In addition, the amount of sag $\delta h$ of the setting can be suitably determined in accordance with the total length L (total length Ls during the setting) of the automobile suspension coil spring. Furthermore, various conventionally known methods can be used for the setting process.

In the warm shot peening step, a coil that has undergone the above-described heat treatment is then subjected to warm shot peening, which improves the durability and the corrosion fatigue resistance by imparting a large compressive residual stress to the coil surface. In the present example, the temperature at which the shot peening is carried out can be suitably set within a temperature range that is equal to or lower than the recrystallization temperature of the wire material and is higher than room temperature. For example, warm shot peening treatment of the coil can be carried out at a coil temperature of 150 to 400° C. Furthermore, various conventionally known methods can be used in a steel ball shot peening method.

In the cold shot peening step, shot peening is carried out with the coil at room temperature, preferably using steel balls. The durability of the coil can be further improved by additionally carrying out cold shot peening after warm shot peening. In this case, the diameter of the steel balls used in the cold shot peening step is preferably smaller than the diameter of the steel balls used in the warm shot peening step. For example, if the diameter of steel balls used in the warm shot peening step is 1.2 mm, then the diameter of steel balls used in the cold shot peening is preferably 0.8 mm. The surface roughness of the coil can improved by performing the cold shot peening step after having imparted a large compressive residual stress in the previously-performed warm shot peening step, thereby further improving the durability and the corrosion fatigue resistance of the coil. Furthermore, various conventionally known methods can be used in the steel ball shot peening step.

In the cold setting step, the setting is carried out with the coil at room temperature. The sag resistance of the coil is further improved by carrying out the cold setting step after performing the above-mentioned hot setting step. The amount of sag $\delta c$ of the cold setting can be suitably determined in accordance with the total length L (total length Ls during the setting) of the automobile suspension coil spring. Furthermore, the amount of sag $\delta c$ of the cold setting is preferably less than the amount of sag $\delta h$ of the hot setting.

Alternatively, the production can also be carried out by only performing the warm shot peening step and the hot setting step, while omitting both of the cold shot peening step and cold setting step described above. In addition, other steps may be included in addition to each of the above-mentioned steps. For example, a water cooling step may be carried out after the hot setting step. In addition, the warm shot peening step may be performed prior to the hot setting step to achieve springs having further improved durability.

As has been explained above, according to the present teachings, a spring steel and a spring having the high strength and the superior durability in terms of the corrosion fatigue strength, etc. can be obtained. Such a spring is preferably used in components of vehicle suspension systems or the like, such as coil springs, leaf springs, torsion bar springs and/or stabilizer bars.

EXAMPLES

The following provides an explanation of examples that embody the present teachings. Furthermore, the following examples are merely specific examples for explaining the present teachings, and do not limit the present teachings or the claims.

Steels of exemplary samples and comparative samples having the chemical compositions shown in Table 1 below were each produced using the following two types of production methods. Specifically, the steels used in Samples 1 to 5 and Comparative Samples 1 to 7, which were utilized for the corrosion fatigue test, were produced according to method (2) below, while the steel used in Comparative Sample 8 was produced according to method (1) below. Moreover, the steels used in the test for determining the Charpy impact value and in the delayed fracture test were produced according to method (2) below.

(1): Steel ingots, which were obtained by melting steel in a blast furnace or an electric arc furnace on a scale equivalent to a mass production, were split into slabs and rolled, followed by rolling into wire rods.

(2) After melting two tons of steel in a vacuum furnace, the melt was split into slabs and rolled, followed by rolling into wire rods.

TABLE 1

(all values are mass %)

| | C | Si | Mn | Cr | P | S | Ni | Cu | Mo | V | Ti | B |
|---|---|---|---|---|---|---|---|---|---|---|---|---|
| Sample 1 | 0.46 | 2.19 | 0.70 | 0.19 | 0.004 | 0.005 | 0.30 | 0.18 | 0.18 | 0 | 0.023 | 0.0020 |
| Sample 2 | 0.46 | 2.17 | 0.69 | 0.19 | 0.005 | 0.007 | 0.27 | 0.01 | 0.08 | 0.09 | 0.024 | 0.0021 |
| Sample 3 | 0.47 | 2.18 | 0.44 | 0.29 | 0.004 | 0.004 | 0.53 | 0.01 | 0.09 | 0.10 | 0.023 | 0.0021 |
| Sample 4 | 0.48 | 2.40 | 0.45 | 0.28 | 0.004 | 0.004 | 0.53 | 0.01 | 0.09 | 0.10 | 0.024 | 0.0020 |
| Sample 5 | 0.47 | 2.38 | 0.45 | 0.29 | 0.004 | 0.004 | 0.55 | 0.01 | 0.18 | 0.10 | 0.024 | 0.0020 |
| Comp. Sample 1 | 0.46 | 2.18 | 0.99 | 0.17 | 0.005 | 0.004 | 0.31 | 0.02 | 0.18 | 0 | 0.023 | 0.0020 |
| Comp. Sample 2 | 0.45 | 2.19 | 0.69 | 0.47 | 0.005 | 0.005 | 0.26 | 0.02 | 0.18 | 0 | 0.022 | 0.0020 |
| Comp. Sample 3 | 0.48 | 1.80 | 0.70 | 0.19 | 0.006 | 0.004 | 0.27 | 0.01 | 0.10 | 0.08 | 0.018 | 0.0017 |
| Comp. Sample 4 | 0.49 | 1.80 | 0.69 | 0.18 | 0.005 | 0.004 | 0.26 | 0.18 | 0.09 | 0.09 | 0.021 | 0.0020 |
| Comp. Sample 5 | 0.48 | 1.80 | 0.95 | 0.19 | 0.006 | 0.004 | 0.26 | 0.01 | 0.08 | 0.08 | 0.022 | 0.0021 |
| Comp. Sample 6 | 0.49 | 1.98 | 0.72 | 0.17 | 0.007 | 0.006 | 0.51 | 0.01 | 0 | 0.19 | 0.021 | 0.0022 |
| Comp. Sample 7 | 0.48 | 1.94 | 0.70 | 0.16 | 0.007 | 0.005 | 0.53 | 0.01 | 0.20 | 0.19 | 0.020 | 0.0023 |
| Comp. Sample 8 | 0.47 | 2.18 | 0.77 | 0.36 | 0.010 | 0.002 | 0.97 | 0.26 | 0 | 0.20 | 0 | 0.0020 |

Testing was carried out on various properties of these steels using the methods described below.

1. Corrosion Fatigue Test (1) Test Piece Preparation

The test pieces were obtained by performing the following steps on the wire rods of each steel in sequence: surface polishing, heating, hot-forming the coil, oil quenching and tempering, thereby forming coil springs. Furthermore, the heating condition was high-frequency induction heating at 990° C., thereby adjusting the spring hardness (post-tempering hardness) to HRC 55. An overview of the resulting coil springs is shown in Table 2 below.

TABLE 2

| Spring shape | Wire diameter (mm) | Coil average diameter (mm) | Free length (mm) | Effective number of turns (turns) | Spring constant (N/mm) |
|---|---|---|---|---|---|
| Cylindrical | ϕ12.4 | ϕ110.9 | 323 | 4.05 | 39.1 |

(2) Test Methods

Pits were artificially formed on the resulting springs, and a fatigue test (Japanese Automobile Standards Organization (JASO) C 604) was conducted in a corrosive environment. The pits were formed by disposing a mask having small holes on the outer surface of each spring at a location (3.1 turns from the end of the coil) where the principal stress amplitude is the greatest, and then forming hemispherical recesses (artificial pits) having a diameter of 600 μm and a depth of 300 μm by electrolytic etching. The stress concentration factor of the perpendicular stress (principal stress) in the torsion load attributable to these pits was 2.2 according to a finite element analysis. An aqueous ammonium chloride solution was used as the electrolyte. The corrosive environment consisted of corroding only the portion of the spring having the artificial pits using a misting apparatus that sprayed a 5% aqueous NaCl solution as the corrosive liquid for 16 hours, and then covering the artificial pit portion circumference with absorbent cotton impregnated with 5% aqueous NaCl solution and preventing it from drying out using an ethylene wrap. The fatigue test was conducted while the spring was in this wrapped state, and the number of oscillating cycles until the test piece broke was determined. A spring oscillating rate of 2 Hz was used in the fatigue test, and excitations were applied by parallel compression using a flat base. The test heights were determined based on a principal stress condition of 507±196 MPa that was determined as if no artificial pits were actually formed in the artificial pit portion (a height of 220 mm at the maximum load (4031 N) and a height of 270 mm at the minimum load (2079 N)). The results are collectively shown in Table 3. In addition, Table 3 also shows the numerical ranges of the chemical compositions for each of formulas (1) to (5), along with indications as to whether the particular numerical values satisfy the particular formulas or not. When a numerical value satisfies a particular formula, a "Y" is indicated, and when a numerical value does not satisfy the particular formula, an "N" is indicated.

2. Charpy Impact Value (1) Test Piece Preparation

Half-size test pieces (in which a U-shaped notch, which measured 2 mm (width)×2 mm (depth)×R1 (bottom of U), was formed in the center portion of a rectangular column having a cross-sectional area of 5×10 mm and a length of 55 mm) were used in each of the samples and the comparative samples.

(2) Heating Conditions

The heating conditions consisted of heating at 900° C. for 30 minutes for Samples 1 and 2 and Comparative Samples 1 and 2, high-frequency induction heating at 960° C. for Comparative Sample 5 and high-frequency induction heating at 990° C. for Samples 3 and 4.

(3) Test Piece Hardness

The hardness after tempering was adjusted to HRC 55.

(4) Test Method

Testing was conducted based on JIS ("Japanese Industrial Standard") Z2242 using room temperature as the testing temperature. The results are shown in Table 3.

3. Delayed Fracture Test (Samples 3 and 4 and Comparative Samples 5 and 8)

Tensile test pieces (with a circular notch having a depth of 1 mm) were used as the test pieces. In addition, a constant-force load, hydrogen-charging method was used as the test method. More specifically, in this test, the delayed fracture is caused by internal hydrogen, wherein a load is applied to the test piece at a constant force while the test piece is immersed in an $H_2SO_4$ solution at pH 3 and a current density of 1.0 mA/cm$^2$ is applied to the test piece in order to charge the hydrogen into the test piece. The amount of time until fracture was measured. The maximum load stress that did not cause fracture after 200 hours or more was estimated as the delayed fracture strength.

The heating conditions for the above-mentioned test pieces were as follows. Specifically, the heating conditions consisted of high-frequency induction heating at 990° C. for Samples 3 and 4, high-frequency induction heating at 960° C. for Comparative Sample 5 and heating at 900° C. for 30 minutes for Comparative Sample 8.

These results are also shown in Table 3, which is attached hereto as FIG. 1.

As shown in Table 3, Samples 1 to 5, which are examples of the present teachings, were all determined to have a satisfactory number of corrosion endurance oscillation cycles. All of these samples also satisfied formulas (1) to (5). In particular, Samples 3 to 5, which exhibited values of 1.35% or more for formula (3), exhibited a high number of corrosion endurance oscillation cycles. In addition, the values were satisfactory with respect to the Charpy impact values for Samples 1 to 4 as well, all of which satisfied equations (1) to (5). On the basis of these findings, it is expected that Sample 5 probably also exhibits a satisfactory Charpy impact value. Moreover, the values were also satisfactory with respect to the delayed fracture strength for Samples 3 and 4, which also satisfied formulas (1) to (5). On the basis of these findings, it is expected that Samples 1, 2 and 5 probably also exhibit satisfactory delayed fracturing properties.

Additional teachings relevant to, and advantageously combinable with the present teachings, are found in, e.g., commonly-owned U.S. Pat. Nos. 4,448,617, 4,544,406, 5,897,717, 6,017,641, 6,027,577, 6,193,816, 6,375,174, 6,543,757, 6,550,301, 6,616,131, 6,648,996, 6,712,346, 6,779,564, 6,836,964, 7,407,555, 7,699,943, 7,776,440, and U.S. Patent Publication Numbers 2009/0079246, 2011/0074077, 2011/0074078 and 2011/0074079, the contents of all of which are hereby incorporated by reference as if fully set forth herein.

The invention claimed is:

1. A steel alloy comprising, in terms of percent by mass:

0.47 to 0.49% C;

2.10 to 2.40% Si;

0.40 to 0.50% Mn;

0.20 to 0.30% Cr;

0.40-0.60% Ni;

0.05-0.20% Mo and 0.05-0.20% V;

the balance being substantially Fe and incidental elements and impurities, and wherein the following formulas (6)-(8) are satisfied:

$$0.730\% \le C(\%)+Mn(\%)/6+Si(\%)/24+Ni(\%)/40+Cr(\%)/5+Mo(\%)/4+V(\%)/14 \le 0.780\% \quad (6);$$

$$0.630\% \le C(\%)+Mn(\%)/6+Si(\%)/24 \le 0.670\% \quad (7); \text{ and}$$

$$1.35\% \le Si(\%)-0.46C(\%)-1.08Mn(\%) \quad (8).$$

2. The steel alloy according to claim 1, wherein both of the following formulas (9) and (10) are also satisfied:

$$159C(\%)-Si(\%)+8Mn(\%)+12Cr(\%) \le 82\% \quad (9) \text{ and}$$

$$6.0C(\%)-Si(\%)-0.3Mn(\%)+1.4Cr(\%) \le 1.0\% \quad (10).$$

3. The steel alloy according to claim 2, wherein the lower limit value of formula (8) is 1.45%.

4. The steel alloy according to claim 3, wherein the upper limit value of formula (9) is 0.81%.

5. The steel alloy according to claim 4, wherein the lower limit value of formula (10) is 0.65%.

6. The steel alloy according to claim 5, wherein the steel alloy further has 0.05% or less Cu.

7. A spring comprising the steel alloy of claim 6.

8. The spring according to claim 7, wherein the spring is a coil spring.

9. The steel alloy according to claim 2, wherein the upper limit value of formula (9) is 0.81%.

10. The steel alloy according to claim 2, wherein the lower limit value of formula (10) is 0.65%.

11. A spring comprising the steel alloy of claim 1.

12. The spring according to claim 11, wherein the spring is a coil spring.

13. The steel alloy according to claim 1, wherein the lower limit value of formula (8) is 1.45%.

14. The steel alloy according to claim 1, wherein after quenching and tempering, the steel alloy has the property that its number of corrosion endurance oscillating cycles is at least 45,000.

15. The steel alloy according to claim 1, wherein after quenching and tempering, the steel alloy has the property that its Charpy impact value is at least 80 J/cm$^2$.

16. The steel alloy according to claim 1, wherein after quenching and tempering, the steel alloy has the property that its delayed fracture strength is at least 910 MPa.

17. The steel alloy according to claim 1, wherein the spring steel has a Rockwell hardness of HRC 53 to 56.

18. The steel alloy according to claim 1, wherein the steel alloy further has:

0.010% or less P, 0.010% or less S, 0.20% or less Cu, 0.005-0.030% Ti, and 0.0015-0.0025% B.

19. The steel alloy according to claim 1, wherein the steel alloy further has 0.05% or less Cu.

* * * * *